US006510660B1

(12) United States Patent
Michioka et al.

(10) Patent No.: US 6,510,660 B1
(45) Date of Patent: Jan. 28, 2003

(54) DAMPING DEVICE

(75) Inventors: Hidekazu Michioka, Tokyo (JP); Masashi Konomoto, Tokyo (JP); Masahiro Yoshihashi, Yamanashi (JP); Yoshihito Watanabe, Tokyo (JP)

(73) Assignee: THK Co., Ltd. (JP)

( * ) Notice: Subject to any disclaimer, the term of this patent is extended or adjusted under 35 U.S.C. 154(b) by 1 day.

(21) Appl. No.: 09/707,733

(22) Filed: Nov. 7, 2000

(30) Foreign Application Priority Data

Nov. 8, 1999 (JP) ..... 11-317532

(51) Int. Cl.[7] ..... E04H 9/02
(52) U.S. Cl. ..... 52/167.7; 52/1
(58) Field of Search ..... 52/1, 167.1, 167.4, 52/167.6, 167.8, 167.7

(56) References Cited

U.S. PATENT DOCUMENTS 5,347,771 A * 9/1994 Kobori et al. ..... 52/167

* cited by examiner

*Primary Examiner*—Carl D. Friedman
*Assistant Examiner*—Naoko Slack
(74) *Attorney, Agent, or Firm*—Kilpatrick Stockton LLP

(57) ABSTRACT

A damping device receiving viscous fluid in an annular gap between a housing and a rotary member within the housing and converting a dynamic energy of the rotary member into a thermal energy is provided. The damping device is constructed to make it possible to move a sealing unit for sealing the annular gap in response to a pressure of the viscous fluid, to change the volume of the annular gap to suppress an adverse affect concomitant with the pressure increase of the viscous fluid to the sealing unit and to enhance reliability and durability of the damping device.

8 Claims, 8 Drawing Sheets

DAMPING DEVICE

BACKGROUND OF THE INVENTION

1. Field of the Invention

The present invention relates to a damping device for converting dynamic energy into thermal energy of fluid concomitant with a relative shift between two points of building structure etc., for example, and damping it.

2. Description of the Related Art

As a conventional device for damping a dynamic energy for relatively shifting between two members (two points) of building structure etc. concomitant with a swing or a vibration due to an earthquake, a traffic vibration or wind, there is provided a device using a method in which this relative motion is converted into rotary motion of a rotary member, and further, due to heat generation by a frictional resistance of viscous fluid contacting with the rotary member, the dynamic energy concomitant with the above-described shift is converted into the thermal energy of viscous fluid, which is the result of the heat generation, and is damped.

Such a damping device is disclosed in, for example, Japanese Patent Application Laid-open No. Hei 10-184757 and Japanese Patent Application Laid-open No. Hei 10-184786.

The damping device shown in these publication is provided with a casing coupled with one of two points, viscous fluid contained within this casing, a rotary member received rotatably within this casing, a screw nut mechanism (double speed mechanism) interposed between the rotary body and the other of the two points.

This screw nut mechanism is composed of a screw shaft coupled to the other of the two points and a nut connected to the above-described rotary member and threadedly engaged with the screw shaft.

In the thus constructed damping device, the screw shaft is shifted in the axial direction relative to the casing upon the generation of the dynamic energy concomitant with the relative shift between the object portions. Then, the rotary member is rotated by the screw engagement action between the screw shaft and the nut and the viscous fluid contacting this rotary member is heated by means of frictional resistance or the like. As a result, the above-described dynamic energy is converted into the thermal energy of the viscous fluid and is damped.

In the above-described damping device, in order to keep the damping performance in a good condition to prevent the above-described viscous fluid from leaking to the outside, a sealing unit (seal member) is interposed between the above-described casing and the rotary member.

The viscous fluid is heated and expanded by the thermal energy that is converted from the dynamic energy and the pressure is increased to thereby impose an excessive load onto the sealing unit, resulting in a reduction shortage in service life of the sealing unit or the generation of leakage exceeding a suitable level.

In particular, in case of structures in which the rotary member is rotated at a high speed by the screw nut mechanism or the like to enhance the conversion rate to thermal energy, like the damping device disclosed in the publications, the temperature elevation and the pressure increase are great so that the adverse affect against the sealing unit would be great.

SUMMARY OF THE INVENTION

In order to overcome the above-noted defects, an object of the present invention is to suppress an adverse affect concomitant with the pressure increase of the viscous fluid to a sealing unit provided in a damping device and to enhance reliability or durability of the damping device.

In order to attain this and other objects, according to the present invention, there is provided a damping device comprising: a container connected to one of two points that move relatively to each other; a moving member coupled to the other of the two points and received relatively movably within the container; a sealing unit retained movably in a gap between the container and the moving member to form a sealed space within the container; fluid received within the sealed space, to be heated by a frictional resistance from the container and the moving body in correspondence with the relative shift between the moving member and the container, as a result to convert into a thermal energy a dynamic energy in correspondence with the relative shift between the two points; and a biasing means for biasing toward the sealed space the sealing unit for moving in response to the pressure of the fluid received in the sealed space, thereby converting a volume of the sealed space.

Thus, the sealing unit is retained movably within the gap so that the sealing unit receiving the pressure moves in a direction in which the volume of the sealing space is increased against the biasing force by the biasing means when the pressure is increased by the heat of the fluid or the like, to thereby suppress the excessive pressure increase of the fluid, and when the pressure of the fluid is decreased, the sealing unit is moved in a direction in which the volume of the sealed space is decreased to suppress the decrease of the pressure of the fluid.

Also, according to another aspect of the present invention, there is provided a damping device comprising: a container connected one of two points that move relatively to each other; a moving member coupled to the other of the two points and received relatively movably within the container; a sealing unit retained in a gap between the container and the moving member to form a sealed space within the container; fluid received within the sealed space, to be heated by a frictional resistance from the container and the moving body in correspondence with the relative shift between the moving member and the container, as a result to convert into a thermal energy a dynamic energy in correspondence with the relative shift between the two points; and a fluid retainer chamber connected to the sealed space for making it possible to pass the fluid between the fluid retainer chamber and the sealed space.

With such an arrangement, the fluid may flow between the sealed space and the fluid retainer chamber when the volume change occurs in accordance with a temperature change of the fluid to thereby make it possible to suppress the pressure change of the fluid.

The connecting portion of the sealed space and fluid retainer chamber is positioned in the vicinity of the sealing unit whereby even if the transmission property of the pressure of the viscous fluid is low, the pressure of the viscous fluid in the vicinity of the sealing unit may be suppressed and the excessive pressure to the sealing unit may be suppressed.

It is preferable that the fluid retainer chamber may comprise a pressure responsible means for moving within the fluid retainer chamber in response to the pressure and for changing the volume of the fluid receiving portion in the fluid retainer chamber.

For example, a piston or a diaphragm is used as the pressure responsible means. When the fluid pressure is increased, the means changes in position and increases the volume of the fluid receiving portion to suppress the increase of the pressure of the fluid.

It is also preferable that the fluid retainer chamber is formed in the interior of the moving member or the side wall portion to simplify the structure of the damping device to provide a compact structure without any projection to the outside. With the pressure responsible means, it is possible to release the fluid retainer chamber to the atmospheric pressure.

Otherwise, in the case where the fluid retainer chamber is kept under the sealed condition, the gas is filled in the interior and it is possible to pressurize the fluid retained in the interior through the pressure responsible means at a predetermined pressure toward the sealed space.

It is preferable that the fluid retainer chamber comprises a bellows for expanding and shrinking in response to the pressure of the fluid introduced therein and for changing the volume of the fluid receiving portion. This makes it possible to provide a simpler structure with a high operational stability.

Also, according to still another aspect of the present invention, there is provided a damping device comprising: a container connected to one of two points that move relatively to each other; a moving member coupled to the other of the two points and received relatively movably within the container; a sealing unit retained in a gap between the container and the moving member to form a sealed space within the container; fluid received within the sealed space, to be heated by a frictional resistance from the container and the moving body in correspondence with the relative shift between the moving member and the container, as a result to convert into a thermal energy a dynamic energy in correspondence with the relative shift between the two points; and an elastic member exposed in a part of a wall surface defining the sealed space and changing a volume in response to a pressure applied from the fluid.

This elastic member is disposed in the concave portion provided in a part of the wall surface defining the sealed space, for example. When the pressure fluid is increased, the volume is decreased to increase the volume of the sealed space to suppress the increase of the fluid pressure.

The elastic member is disposed in the vicinity of the sealing unit whereby even if the fluid is the viscous fluid and the transmission property of the pressure is low, the pressure of the fluid in the vicinity of the sealing unit is suppressed and the application of the excessive pressure to the sealing unit may be suppressed.

The elastic member is made of rubber elastic material, for example, and it is possible to use any shape such as a solid form, a hollow form or a foamed form.

It is preferable that the fluid comprises viscous fluid; the moving member comprises a rotary member received rotatably within the container; and the rotary member comprises a screw shaft coupled with the other of the two points and a nut connected to the rotary member and threadedly engaged with the screw shaft and the rotary member is coupled with the other of the two points through a rotary mechanism for converting a reciprocating motion of the screw shaft into a rotary motion of the rotary member.

With the rotary mechanism, the relative shift between the two points is converted into the rotary motion, the frictional resistance by the viscous fluid is increased so that the conversion efficiency to the thermal energy may be set at a high level to enhance the damping effect.

According to the present invention, it is possible to suppress the adverse affect concomitant with the pressure increase of the fluid against the sealing unit provided in the damping device to make it possible to enhance reliability and durability of the damping device.

DESCRIPTION OF THE PREFERRED EMBODIMENTS

Embodiment 1

Figure 1:
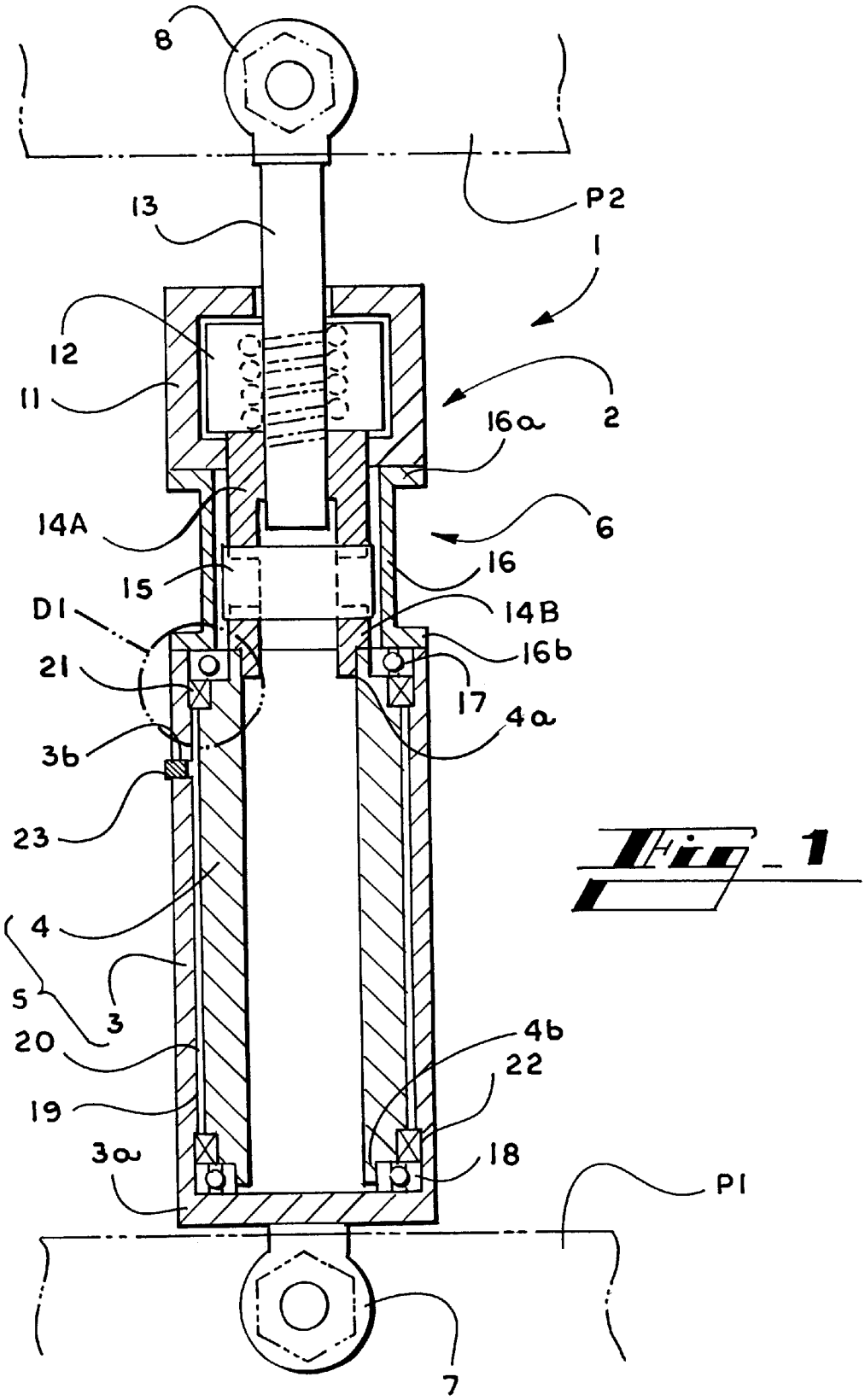
FIG. 1 is a cross-sectional view illustrating a schematic structure of a damping device in accordance with an embodiment of the present invention.

A first embodiment of the present invention will now be described with reference to the accompanying drawings. FIG. 1 is a cross-sectional view illustrating a structure of a damping device 1 to which the present invention is applied. Incidentally, the characterized portions will be described with reference to the enlarged views.

A screw shaft and a container that constitute the damping device are mounted on the mounting portions P1 and P2 such as two points of building structure or the like that relatively shifts in accordance with a swing or a vibration due to, for example, an earthquake or a traffic vibration.

When a relative shift is generated between the two points of the building structure etc., the screw shaft is shifted in the axial direction relative to the container. Then, the shift is converted into a rotary motion of the rotary member by the screw engagement action between the screw shaft and the nut. Furthermore, the viscous fluid contacting the rotary member is heated by means of the frictional resistance or the like. As a result, the energy concomitant with the above-described shift is converted into a thermal energy of the viscous fluid and is damped.

The damping device 1 basically includes a rotary mechanism 2 for converting a reciprocating motion of the mounting portions P1 and P2 into the rotary motion, a damping portion 5 having a housing 3 as a container and a rotary member 4 having a cylindrical shape as a moving member received in the housing 3, a joint portion 6 for coupling the rotary mechanism 2 and the damping portion 5, and connecting end portions 7 and 8 for coupling the damping device 1 to the mounting portions P1 and P2.

The rotary mechanism 2 is provided with a cylindrical case 11, a ball screw nut 12 as a nut received in the case 11 and a screw shaft 13 threadedly engaged with the ball screw nut 12.

One end of the screw shaft 13 becomes the connecting end portion 8 fixed to the mounting portion P2 and the other end becomes a free end in the interior of the joint portion 6.

A connection ring 14A is fixed to the ball screw nut 12 so that the rotary motion into which the reciprocating motion given to the screw shaft 13 is converted may be transferred to the rotary shaft 4 through a connection ring 14B on the side of a joint unit 15 and a rotary body 4.

The joint nut 15 is used to transmit the rotary motion of the ball screw nut 12 to the rotary body 4 while absorbing the eccentricity of the screw shaft 13 and the rotary member 4. It is possible to use any joint of various conventional methods and structure. However, it is possible to use, for example, an Oldham joint to keep high the transmission efficiency of the rotary motion to be transmitted and to provide in a central portion of an intermediate member a hole through which the screw shaft 13 passes, thus it is also possible to suppress the full length while avoiding an interference with the screw shaft 13.

The joint portion 6 is composed of a sleeve 16 having flanged portions 16*a* and 16*b* at both ends for coupling the case 11 and the housing 3 with each other by means of coupling units such as screws.

The damping portion 5 has a cylindrical housing 3 in which the connecting end portion 7 is fixed to a seal end face 3*a* and the rotary member 4 received coaxially within the housing 3.

A connection ring 14B is fitted and fixed to the joint portion 6 side of the rotary member 4. Both ends of the rotary member 4 that are reduced in diameter are formed into bearing engagement portions 4*a* and 4*b*. The rotary member 4 is rotatably supported through bearings 17 and 18 fixed to the inner cylindrical portion of the housing 3 (through sleeves in some cases).

An annular gap 19 is formed between the inner circumferential surface of the housing 3 and the outer circumferential surface of the rotary member 4. The sealing of both end portions are performed by sealing units 21 and 22 disposed inside the bearings 17 and 18 to form a sealing space into which viscous fluid 20 is contained. The viscous fluid 20 that is the working fluid is contained therein.

It is possible to use various kinds of fluid as the viscous fluid 20. It is preferable to use one whose composition is kept unchanged for a long period of time. Also, the viscous fluid may include the viscous elastic material having the elasticity and one having no elasticity.

More specifically, the viscous fluid 20 may be selected from polyisobutylene and silicone oil. Incidentally, the viscous fluid 20 is filled through a plug hole 3*b* provided in the housing 3 and the plug hole 3*b* is closed after the filling operation.

The structure for retaining the sealing units 21 and 22 will now be described in more detail with reference to FIGS. 2A, 2B and 2C.

The basic operation of the damping device 1 will now be described. When the two points (mounting portions P1 and P2) coupled with the connecting end portions 7 and 8 of the damping device 1 are relatively shifted away from or close to each other due to an earthquake or the like, the screw shaft 13 is reciprocatingly moved in the axial direction relative to the housing 3.

The reciprocating motion of the screw shaft 13 is converted into the rotary motion of the ball screw nut 12 that is engaged with the screw shaft 13 and the rotary motion of the ball screw nut 12 is transmitted to the rotary member 4 through the connection ring 14A, the joint unit 15 and the connection ring 14B to thereby rotate the rotary member 4.

Incidentally, the rotational speed (velocity of the outer circumferential surface) of the rotary member 4 is set to be large in comparison with the relative shift velocity to the housing 3 of the screw shaft 13 by the rotary mechanism 2.

Then, when the rotary member 4 rotates, the frictional resistance is generated in accordance with the fluidization of the viscous fluid 20 received in the annular gap 19. As a result, the dynamic energy concomitant with the rotary motion of the rotary member 4 is converted into the thermal energy of the viscous fluid 20 to damp the dynamic energy concomitant with the relative shift between the two points to make it possible to protect the building structure.

Figure 2A:
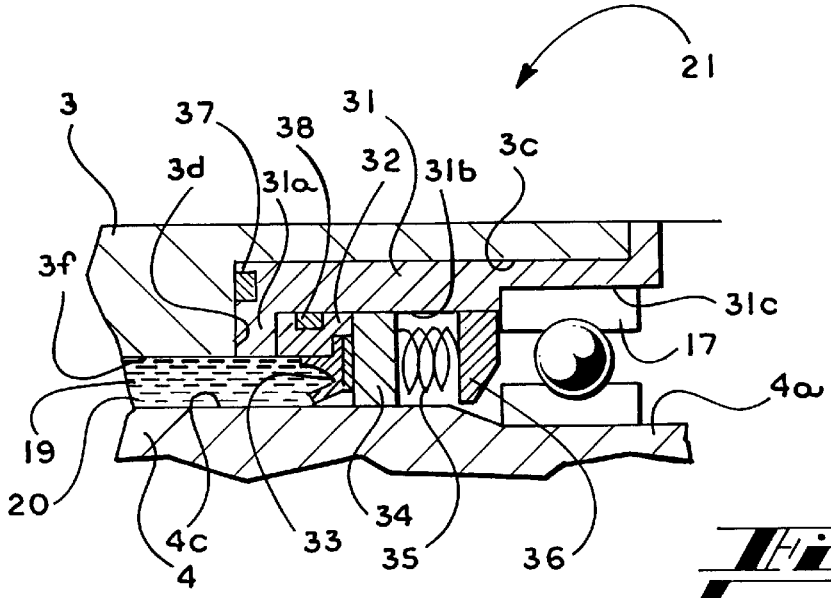
FIGS. 2A, 2B and 2C are enlarged cross-sectional views of a primary part of a damping device (Embodiment 1)
Figure 2B:
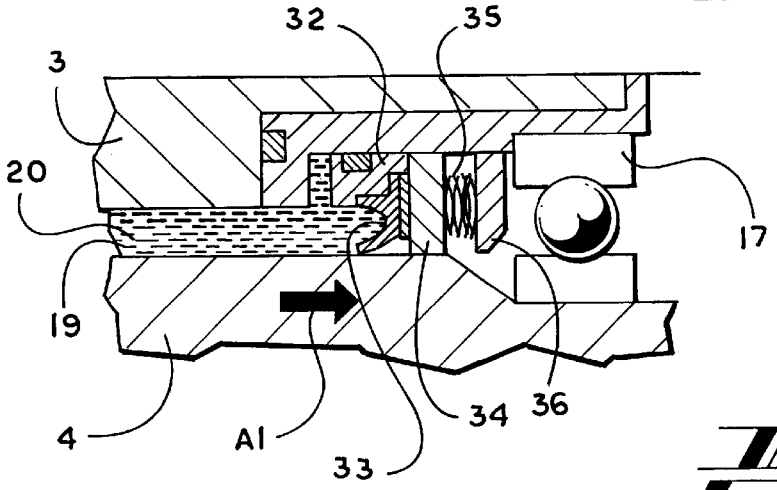
Figure 2C:
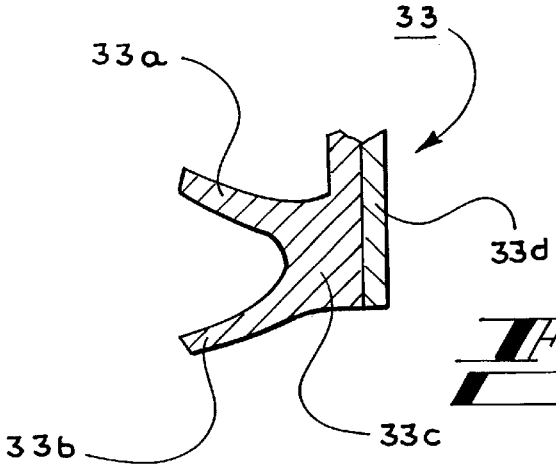

FIGS. 2A, 2B and 2C are views illustrating the structure for retaining the sealing units 21 and 22 in detail. FIGS. 2A and 2B are enlarged views of the portion D1 of FIG. 1 and FIG. 2C is an enlarged view of an oil seal 33 only.

The viscous fluid 20 contained in the annular gap 19 is heated and likely to expand in volume by the frictional resistance or the like generated in accordance with the rotary motion of the rotary member 4. Since both ends of the annular gap 19 are sealed by the sealing units 21 and 22, in the case where the volume of the annular gap 19 is kept constant as in the conventional cases, an excessive load is applied to the sealing units 21 and 22 to shorten the service life of the sealing units 21 and 22 and to generate the leakage of the viscous fluid to exceed the suitable level.

In the embodiment, it should be noted that the sealing positions of the sealing units 21 and 22 are changed in accordance with a pressure of the viscous fluid 20 to change the volume of the annular gap 19 (to increase and decrease the volume in accordance with the change in pressure) to thereby suppress the pressure increase of the viscous fluid 20.

The end portion of the housing 3 on the side of the joint portion 6 is formed into the engagement portion 3*c* in which is fitted a retainer sleeve 31. The engagement portion 3*c* is enlarged in diameter by one step to the inner circumferential surface 3*f* on the central portion of the annular gap 19.

The side of the insertion tip end of the retainer sleeve 31 to the housing 3 is formed into an abutment end portion 31*a* to come into contact with a stepped portion 3*d* for connecting the inner circumferential surface 3*f* of the central portion and the engagement portion 3*c* with each other.

A bearing engagement portion 31*c* and a sliding surface 31*b* are formed at a rear end side to the abutment portion 31*a*.

Then, an oil seal retainer ring 32 for retaining the oil seal 33, a pressure adjuster plate 34, a spring 35 used as a biasing means, a spring receiver 36 and a bearing 17 are arranged onto the sliding surface 31*b* of the retainer sleeve 31 from the inside to the outside in the axial direction (toward the joint portion 6).

The oil seal 33 is provided with an outer lip 33*a* in contact with the inner circumferential surface of the oil seal retainer ring 32, an inner lip 33*b* in contact with the sliding surface 4*c* that is the outer circumferential surface of the rotary member 4, a fitting portion 33*c* for retaining both the lips, and a reinforcement ring 33*d* for retaining the form and the fitting strength of the oil seal 33. The reinforcement ring 33*d* is in contact with and supported to the pressure adjuster plate 34.

The pressure adjuster plate 34 is an annular member movably disposed in the axial direction between the sliding surface 31*b* and the sliding surface 4*c* and is biased by means of the spring 35 in a direction in which the volume of the annular gap 19 is decreased.

A spring receiver plate 36 is fixed to the retainer sleeve 31 together with the bearing 17.

O-ring type seal members 37 and 38 prevent the leakage of the oil from the gaps between the contact surfaces.

Thus, the sealing unit 21 is held substantially movably within the annular gap 19 (the other side sealing unit 22 may be formed in the same structure). Thereby when the pressure is increased due to the heating of the viscous fluid 20, as shown in FIG. 2B, the oil seal 33 that is subjected to the pressure is moved in a direction (indicated by the arrow A1) against the biasing force of the spring 35, thus preventing the excessive pressure increase of the viscous fluid 20.

Also, when the pressure of the viscous fluid 20 is decreased (returned back to the original pressure), the pressure adjuster plate 34 is moved in a direction in which the volume of the annular gap 19 (sealed space) (to the original position), to thereby suppress the reduction in pressure of the viscous fluid 20.

Accordingly, the adverse affect concomitant with the pressure increase of the viscous fluid 20 against the sealing units 21 and 22 provided in the damping device 1 may be suppressed to thereby enhance the reliability or durability of the damping device 1.

Incidentally, in this embodiment, the spring 35 is used as the biasing means. However, it is possible to adopt any desired form such as a coiled shape or a leaf shape as the spring form. Also, it is possible to use an elastic member such as a rubber-like elastic member for the spring 35.

Figure 3A:
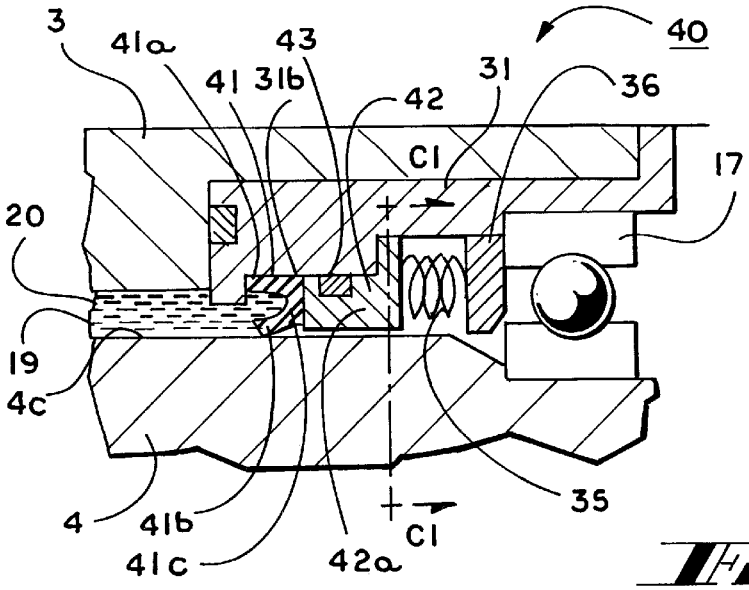
FIGS. 3A and 3B are enlarged cross-sectional views of the primary part of the damping device (other structure of Embodiment 1)
Figure 3B:
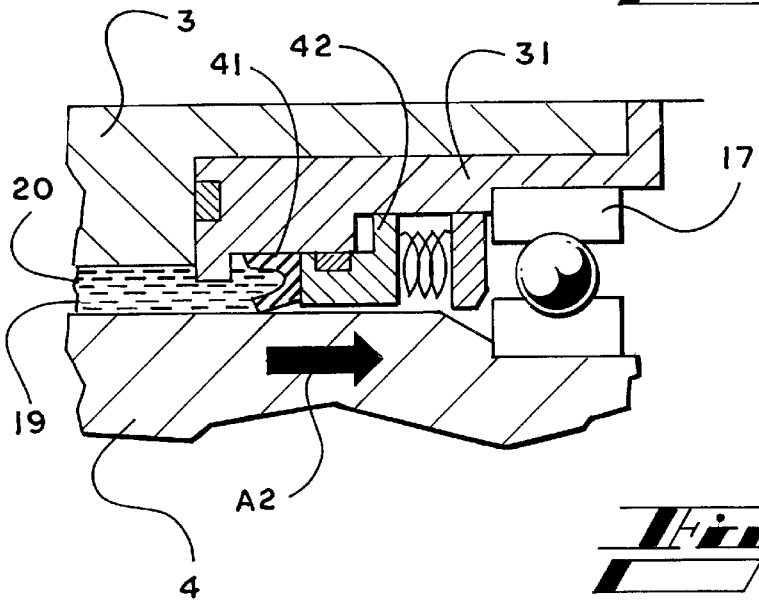

FIGS. 3A and 3B are views illustrating another structure in accordance with the first embodiment. FIG. 3A shows a state in which the sealing unit 40 is located in the normal position and FIG. 3B shows a state in which the sealing unit 40 is subjected to the pressure of the viscous fluid 20 to move in a direction indicated by an arrow A2. Incidentally, the same reference numeral is used to indicate the same members or component in FIGS. 2A, 2B and 2C.

In this structure, the oil seal 41 that is one of the constituents of the sealing unit 40 is provided with lips 41*a* and 41*b* in contact between the sliding surface 31*b* of the retainer sleeve 31 and the sliding surface 4*c* of the rotary member 4 and a lip coupling portion 41*c* coupling the lips 41*a* and 41*b* with each other in contact with the pressure retainer plate 42.

The pressure adjuster plate 42 is provided with a cylindrical piston portion 42*a* that is slidingly movable in the axial direction between the sliding surface 31*b* and the sliding surface 4*c* and is biased by a spring 35. An annular groove is formed in the outer circumferential surface of the piton portion 42*a*. An O-ring type seal member 43 is fitted therein.

With such a sealing unit 40, it is possible to change the volume of the annular gap 19 (sealed space) to suppress the adverse affect concomitant with the pressure increase of the viscous fluid 20 against the sealing unit 40 provided in the damping device 1 to make it possible to enhance reliability or durability of the damping device 1.

Figure 4:
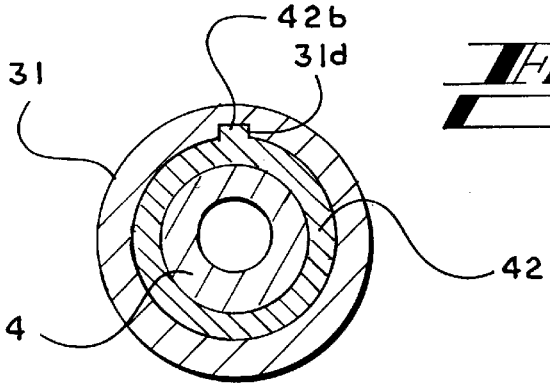
FIG. 4 is a view illustrating a rotation preventing mechanism of a pressure adjuster plate.

As shown in FIG. 4, that is a cross-sectional view taken along the line C1—C1 of FIG. 3A, it is possible to provide a key groove 31*d* in the retainer sleeve 31 as the rotation preventing means for the pressure adjuster plate 42 and to provide a key portion 42*b* in the pressure adjuster plate 42 to engage both with each other.

Embodiment 2

Figure 5:
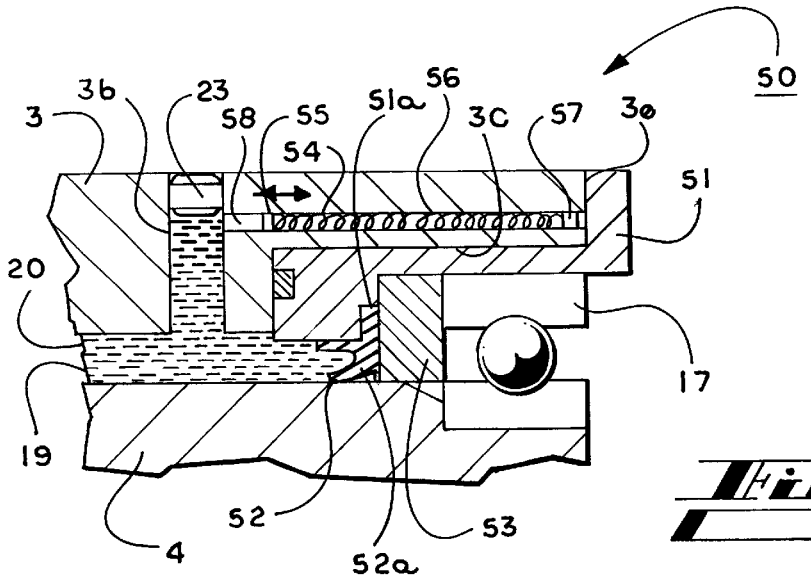
FIG. 5 is an enlarged cross-sectional view of a primary part of a damping device (Embodiment 2)

FIG. 5 is a cross-sectional view showing a characteristic structure of a second embodiment of the present invention applied to a damping device. In FIG. 5, the same reference numeral is used to indicate the same member or component shown in FIG. 1.

In the sealing unit 50 in accordance with the second embodiment of the present invention, the interior of the annular gap 19 between the housing 3 and the rotary member 4 is not held to be movable unlike the sealing units 21 and 40 in accordance with the first embodiment, the housing 3 is fixed in a position specified by both ends of the annular gap 19 (the same structure is used on the opposite side not shown in FIG. 5).

The retainer sleeve 51 is fitted and fixed to the engagement portion 3*c* of the housing 3. An oil seal 52 provided with an outward flange 52*a* is fixed between a stepped portion of the retainer sleeve 51 and an end face of a fixture ring 53. A bearing 17 is fitted and fixed to the outside of the fixture ring 53.

Also, a communication hole 54 in communicating with the plug hole 3*b* to be used for filling the viscous fluid 20 from an end face 3*e* is provided in a side wall portion constituting the engagement portion 3*c* that is an end portion of the housing 3.

A piston member 55 that is a pressure responsible means to sealingly move along the inner circumferential surface of the communication hole 54 is arranged to be biased toward the viscous fluid 20 by the spring 56. Reference numeral 57 denotes a plug for retaining the spring 56.

The viscous fluid 20 is introduced from the plug hole 3*b* into the communication hole 54. A fluid retainer chamber 58 (fluid containing portion) is formed up to a piston member 55.

With the thus constructed fluid retainer chamber 58, when the volume change occurs in accordance with the temperature change of the viscous fluid 20, the viscous fluid 20 passes between the annular gap 19 and the fluid retainer chamber 58 whereby the fluid retainer chamber 58 serves as a buffer for the viscous fluid 20 to make it possible to suppress the pressure change of the viscous fluid 20.

The piston member 55 is moved in the axial direction within the communication hole 54 in response to the pressure of the viscous fluid 20 to change the volume of the fluid retainer chamber 58. The piston member 55 is shifted to expand the volume of the fluid retainer chamber 58 to thereby suppress the pressure when the viscous fluid 20 is increased. Also, when the pressure of the viscous fluid 20 is decreased (returned back to the original pressure), the volume of the fluid retainer 58 is reduced.

Accordingly, it is possible to suppress the adverse affect concomitant with the pressure increase of the viscous fluid 20 to the sealing unit 50 provided in the damping device 1 to enhance the reliability and durability of the damping device 1.

Here since the fluid retainer chamber 58 is formed in the side wall portion of the housing 3, the structure of the damping device 1 may be simplified and the compact structure is attained in which no projection is present in the outer side.

Incidentally, a plurality of the fluid retainer chambers 58 may be provided on the side wall portion of the housing, or the fluid retainer chamber may be provided on the outside of the housing 3.

Figure 6:
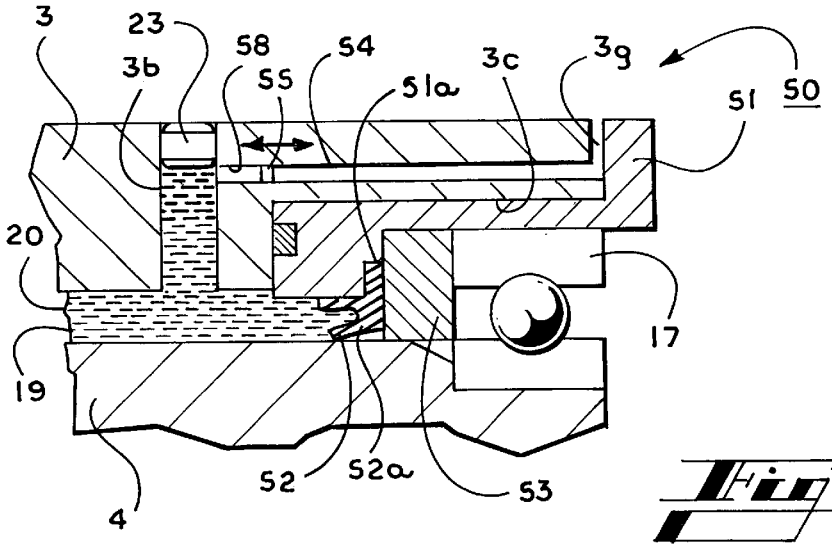
FIG. 6 is an enlarged cross-sectional view of the primary part of the damping device (Embodiment 2)

Also, as shown in FIG. 6, the fluid retainer chamber 58 may be released to the atmospheric environment. In this case the sufficient amount of capacity is given to the fluid retainer chamber 58 for the viscous fluid 20 to be introduced therein to thereby make it possible to cope with the leakage.

In FIG. 6, the spring 56 within the fluid retainer chamber 58 may be dispensed with and a vent hole 3*g* is provided at the end portion of the retainer sleeve 51.

Otherwise, in the case where the structure of the sealed fluid retainer chamber 58 is adopted, gas is sealed within the interior to make it possible to pressurize the viscous fluid 20 at a predetermined pressure. In sealing gas, in FIG. 5, the gas is sealed in a region of the portion of the communication hole 54 to the spring 56 from the piston member 55. Also, it is possible to use a structure where no spring 56 is provided irrespective of the seal of gas.

Incidentally, the fluid retainer chamber 58 is positioned in the vicinity of the sealing unit 50 whereby even if the transmission property of the pressure of the viscous fluid 20 is low, the pressure of the viscous fluid 20 in the vicinity of the sealing unit 50 may be suppressed and the excessive pressure to the sealing unit 50 may be suppressed.

Figure 7:
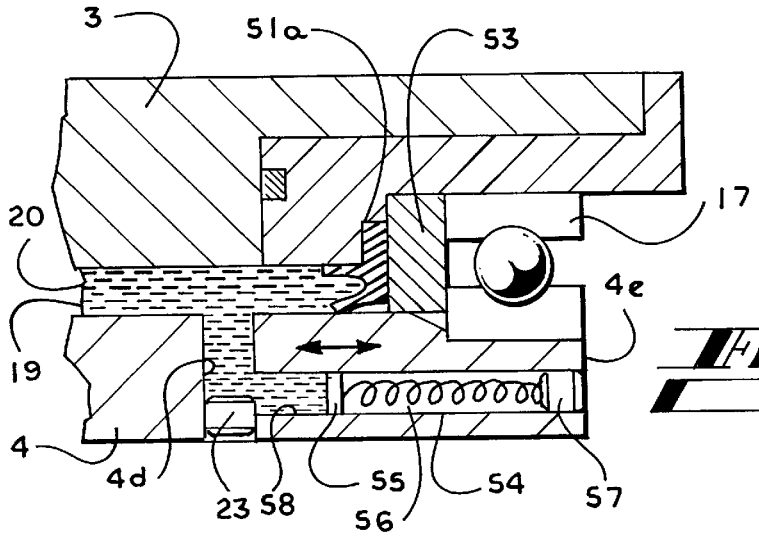
FIG. 7 is an enlarged cross-sectional view of the primary part of the damping device (Embodiment 2)

FIG. 7 is a view showing another structure according to the second embodiment of the present invention. A plug hole 4*d* is provided for filling the viscous fluid 20 to the rotary member 4 and a communication hole 54 is provided from an end face 4*e* of the rotary member 4 to the plug hole 4*d* for filling the viscous fluid 20.

The internal structure of the communication hole 54 is the same as that shown in FIG. 5. The structure is provided with the piston member 55, the spring 56, the plug 57 and the fluid retainer chamber 58 to ensure the same effect and result.

Embodiment 3

Figure 8:
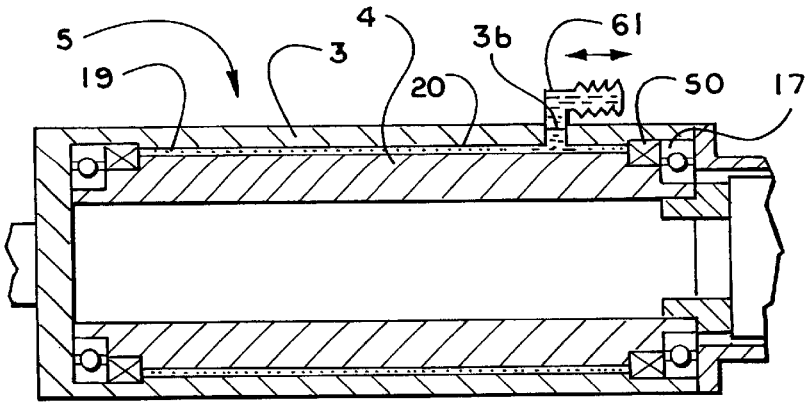
FIG. 8 is a cross-sectional view of a primary part of a damping device (Embodiment 3)

FIG. 8 is a cross-sectional view showing a damping portion 5 illustrating a characteristic feature of a third embodiment of the present invention applied to the damping device 1. In FIG. 8, the same reference numerals are used to indicate the same members or components as shown in FIGS. 1 and 5.

A sealing unit 50 fixed as shown in FIG. 5 is provided as a sealing device for sealing an annular gap 19 between the housing 3 and the rotary member 4.

In this embodiment, a bellows 61 having the interior as a fluid receiving portion is connected to the plug hole 3*b* as the fluid retainer chamber.

The interior of the bellows 61 is filled with the viscous fluid 20 through the plug hole 3*b*. The bellows 61 is expanded or shrunken in response to the pressure of the viscous fluid 20 to change the volume of the fluid receiving portion.

The bellows 61 is expanded or shrunken in the axial direction (indicated by the both-headed arrow) in response to the pressure of the viscous fluid 20 and is expanded to increase the volume to suppress the increase of the pressure of the viscous fluid 20 when the pressure of the viscous fluid 20 is increased. Also, when the pressure of the viscous fluid 20 is decreased (returned back to the original pressure), the bellows decreases its volume (returns back to the original one).

Accordingly, the adverse affect concomitant with the pressure increase of the viscous fluid 20 against the sealing units 50 provided in the damping device 1 may be suppressed to thereby enhance the reliability and durability of the damping device 1.

Embodiment 4

Figure 9A:
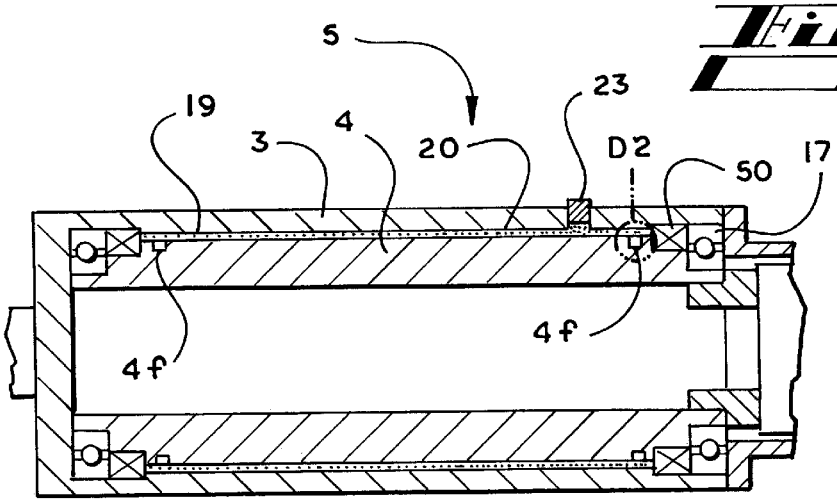
FIGS. 9A, 9B and 9C are a cross-sectional view and enlarged cross-sectional views of a primary part of a damping device (Embodiment 4)
Figure 9B:
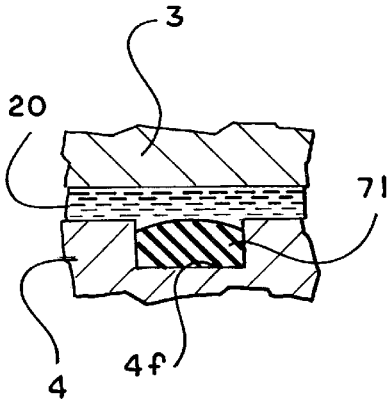
Figure 9C:
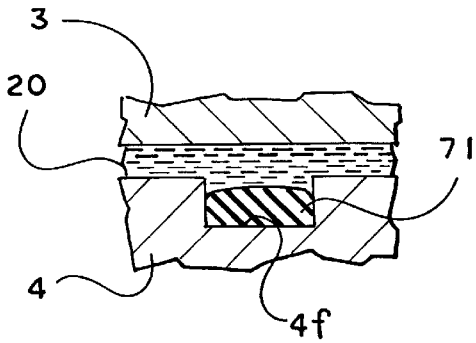

FIG. 9A is a cross-sectional view showing a damping portion 5 illustrating a characteristic feature of a fourth embodiment of the present invention applied to the damping device 1. In FIGS. 9A, 9B and 9C, the same reference numerals are used to indicate the same members or components as shown in FIGS. 1 and 5. FIGS. 9B and 9C are enlarged views of a portion D2 of FIG. 9A.

A sealing unit 50 fixed as shown in FIG. 5 is provided as a sealing device for sealing an annular gap 19 between the housing 3 and the rotary member 4.

In this embodiment, two concave grooves 4*f* are provided as recessed portions in an outer circumferential surface facing the annular gap 19 in the vicinity of the sealing unit 50 at both ends in the axial direction of the rotary member 4. Rubber rings 71 as elastic members whose volume is changed in response to the pressure applied from the viscous fluid 20 are provided in the concave recesses 4*f*.

As shown in FIG. 9C, when the pressure of the viscous fluid 20 is increased, the volume of the rubber ring 71 is decreased to expand the volume of the annular gap 19 that is the sealed space to suppress the increase of the pressure. Also, when the pressure of the viscous fluid 20 is returned back to the original pressure, the volume of the rubber ring 71 is also returned back to the original volume.

Incidentally, the elastic member is positioned in the vicinity of the sealing unit 50 whereby even if the transmission property of the pressure of the viscous fluid 20 is low, the pressure of the viscous fluid 20 in the vicinity of the sealing unit 50 may be suppressed and the excessive pressure to the sealing unit 50 may be suppressed.

The elastic member is made of, for example, rubber elastic material and may be formed into a solid form, a foamed form or a hollow form as described later.

Also, the arrangement position thereof is not limited to the rotary member 4 but may be provided on the side of the housing 3.

Also, the form thereof is not limited to the ring form but it is possible to use various forms such as a circular shape or a rectangular (it is necessary to fix and retain the elastic member to avoid the movement thereof). It is also possible to adopt a structure in which the elastic member is provided at a tip end portion inside of the plug as a circular form. In this case, it is possible to adjust an extent of the decrease of the pressure by setting a suitable number of the plugs and selecting the size of the plugs.

Embodiment 5

Figure 10:
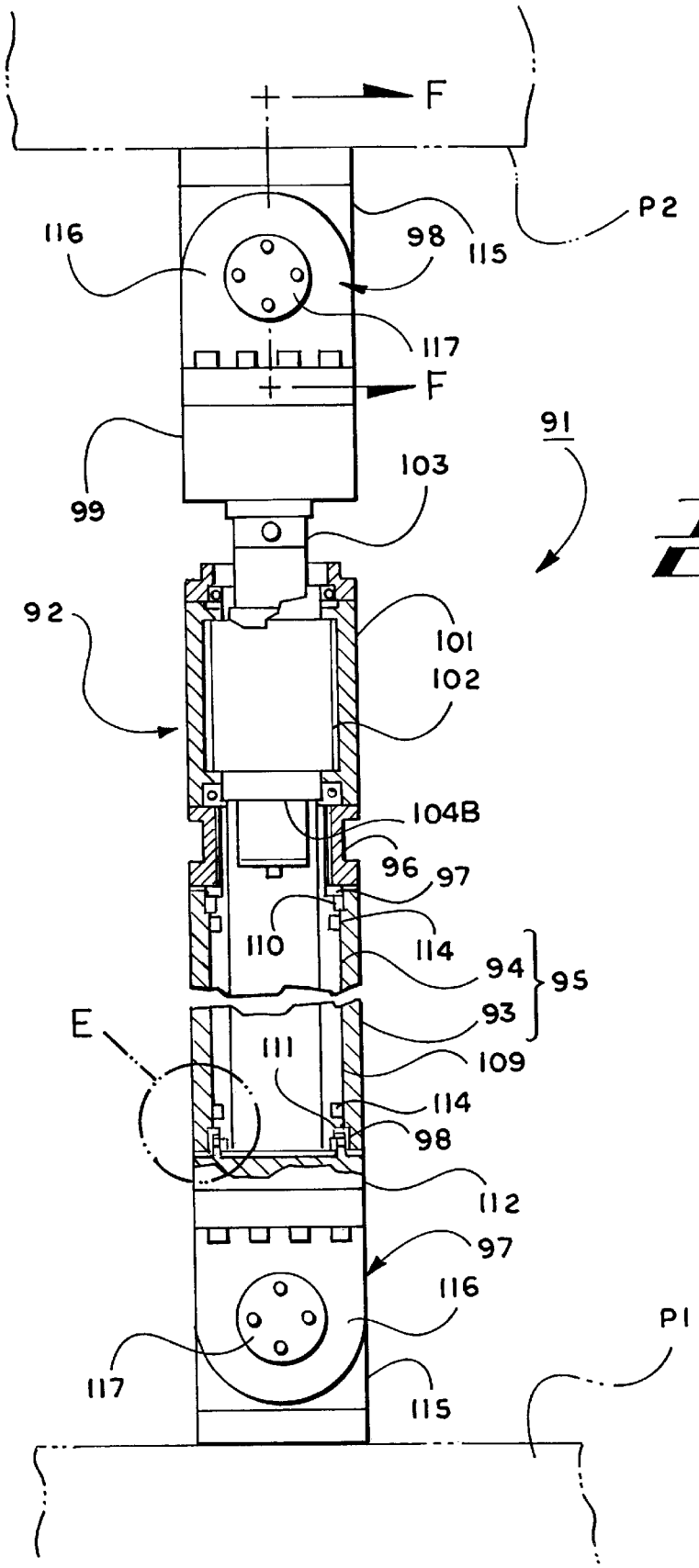
FIG. 10 is a sectional view of a primary part of a damping device (Embodiment 5)

FIG. 10 is a cross-sectional view illustrating a primary part of a structure of a damping device 91 to which the present invention is applied. The damping device 91 is mounted between the mounting portions P1 and P2 such as building structure or the like in the same manner as in the damping device 1 shown in FIG. 1.

The damping device 91 is provided with a rotary mechanism 92 for converting into a rotary motion a reciprocating motion of the mounting portions P1 and P2, a damping portion 95 having a housing 93 as a container and a rotary member 94 having a cylindrical form as a moving member received in the housing 93, a joint portion 96 for coupling the rotary mechanism 92 and the damping portion 95, and connection portions 97 and 98 for coupling the damping device 91 to the mounting portions P1 and P2.

The rotary mechanism 92 has a cylindrical case 101, a ball screw nut 102 received in this case 101 and a screw shaft 103 threadedly engaging with the ball screw nut 102.

One end of the screw shaft 103 is fixed and connected to the mounting portion P2 through a joint portion 99 and a connection portion 98 and the other end becomes a free end in the interior of the joint portion 96. In the same manner as in FIG. 1, the rotary member 94 is connected through a connecting ring (not shown), a joint means (not shown) and a connecting ring 104B on the rotary member 94 side to the ball screw nut 102. An outer circumferential surface of the rotary member 94 is formed to have a stepped portion. Both ends of the larger diameter portions are supported rotatably to the housing 93 through bearings 107 and 108.

Figure 11A:
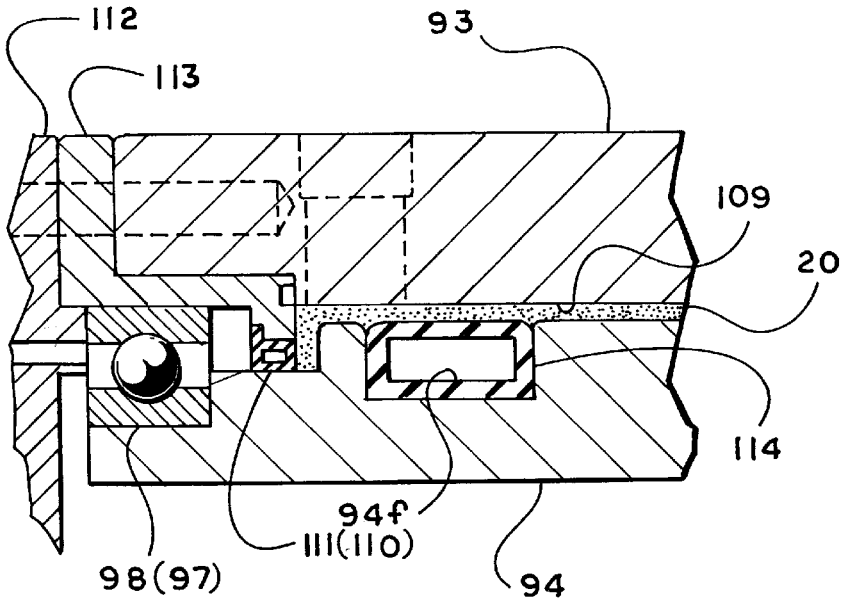
FIG. 11 is an enlarged view of the primary part of the damping device (Embodiment 5)

As shown in FIG. 11A that is an enlarged view of a portion E of FIG. 10, an annular gap 109 receiving the viscous fluid 20 is formed between the inner circumferential surface of the housing 93 and the outer circumferential surface of the rotary member 94. The seal of both end portions thereof is attained by oil seals 110 and 111 arranged inside of the bearings 97, 98. These oil seals 110 and 111 are retained on the inner circumferential surface of oil seal retainer ring 113 mounted between the housing 93 and a lid portion 112.

The concave grooves 94*f* (each provided for associated end portion) are provided, at the outer circumferential surface which is the end portions in the axial direction of the rotary member 94 and facing the annular gap 109 in the vicinity of the oil seals 110, 111. The hollow shaped-rubber rings 114 as the elastic members whose volume is changed in response to the pressure applied from the viscous fluid 20 are fitted in the concave grooves 94*f*.

Figure 11B:
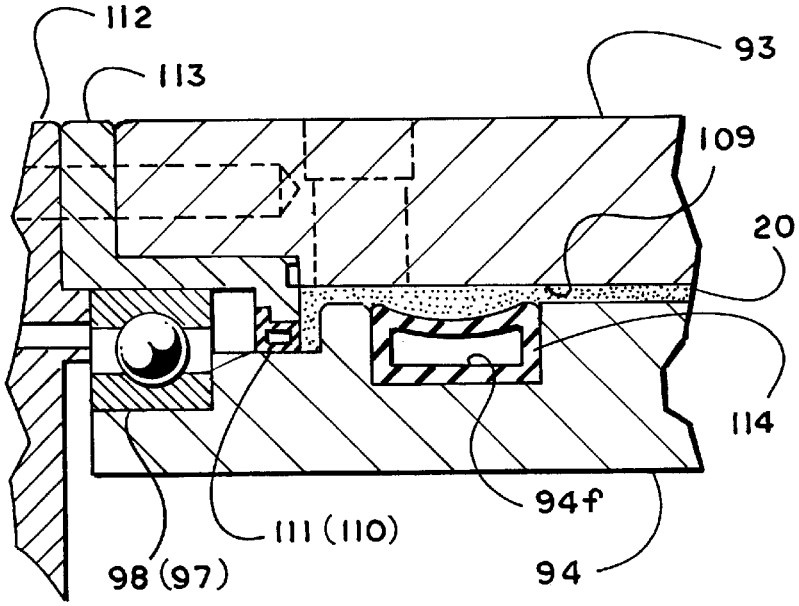

Even if the pressure of the viscous fluid 20 is increased due to the thermal expansion by the rubber ring 114, as shown in FIG. 11B, the volume of the rubber ring 114 is shrunken, the volume of the annular gap 109 that is the sealed space is expanded to thereby suppress the pressure increase of the viscous fluid 20. Incidentally, when the pressure of the viscous fluid 20 is returned back to the original pressure, the volume of the rubber ring 114 is returned back to the original volume.

Here, a comparison will be made as to how the pressure of the viscous fluid 20 within the annular gap 109 is different due to the absence/presence of the rubber ring 114.

Assuming that the pressure within the rubber ring 114 before mounting be P0 (P0=1 atm), the volume is Vp, the pressure within the rubber ring 114 after mounting be P, the volume be (Vp−ΔV) (ΔV is the volume change), and the gas within the rubber ring 114 be an ideal gas, the following equation 1 is given:

$$P0\times Vp=P\times(Vp-\Delta P)=C \quad (1)$$

where P0 is the pressure within the rubber ring 114 before mounting (P0=1), Vp is the volume of the rubber ring 114 before mounting, P is the pressure of the rubber ring 114 after mounting, ΔV is the volume change within the rubber ring 114 before and after mounting, C is the constant.

Also, the relationship between the pressure P' of the viscous fluid 20 within the annular gap 109 and the volume V in the case where the no rubber ring 114 is used is given as follows:

$$P'=12.5((\Delta V/V)\times 100)^2+57.5((\Delta V/V)\times 100)+1 \quad (2)$$

where P' is the pressure of the viscous fluid 20 in the case where no rubber ring 114 is used and V is the volume of the viscous fluid 20 in the case where no rubber ring 114 is used.

Here, ΔV is obtained from the equation 1 and this ΔV is substituted into the equation 2 whereby in the case where the rubber ring 114 is not used, when the viscous fluid 20 becomes a temperature to be thermally expanded by the same amount ΔV, it is possible to obtain the pressure P' generated in the viscous fluid 20.

Now, in the case where the rubber ring 114 is used, assume that P=2.5 (atm), and Vp=2,000 ($mm^3$), and these values are substituted into the equation 1 to obtain $$\Delta V=Vp-Vp/P=2{,}000-(2{,}000/2.5)=1{,}200\ (mm^3).$$

Also, in the case where the rubber ring 114 is not used, assume that V=41,000 ($mm^3$) and substitute this and the above-described ΔV=1,200 ($mm^3$) into the above-described equation 2 to thereby obtain the following equation:

$$P'=12.5\times(1200/41000)^2+57.5\times(1200/41000)+1=276.37\ (atm)$$

Namely, even if in the case where the rubber ring 114 is not used, the pressure of the viscous fluid 20 is high at 276 (atm), the rubber ring 114 is provided to make it possible to suppress the pressure of the viscous fluid 20 to about 2.5 (atm).

Thus, the hollow shaped-rubber ring 114 is provided whereby even if the temperature of the viscous fluid 20 is elevated, there is no fear that the excessive load is applied to the oil seals 110 and 111. Accordingly, for example, in the case where the oil seals 110 and 111 having the durability performance of about 150 (atm), it is possible to prevent the shortage of the service life of the oil seals 110 and 111 or the generation of leakage of the viscous fluid 20.

Also, in the present embodiment, as shown in FIG. 10, the connection portions 97 and 98 are rotatable. The lower connection portion 97 is mounted directly on the damping device 91, whereas the upper connection portion 98 is mounted on the screw shaft 103 of the damping device 91 through the joint 99. The joint 99 is fixed to the screw shaft 103 by bolts.

Figure 12:
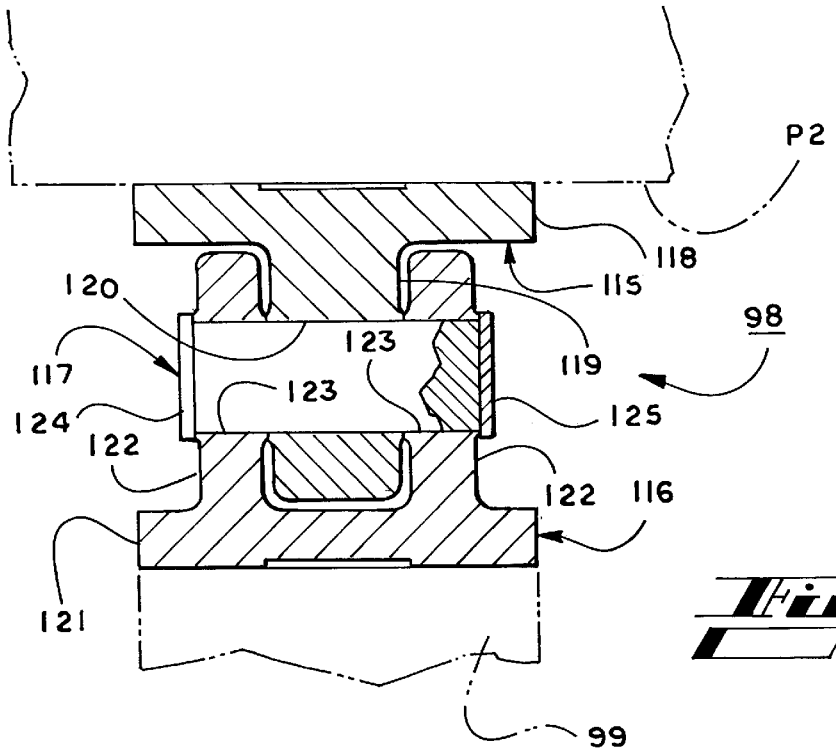
FIG. 12 is a cross-sectional view of the connection portion of the damping device (Embodiment 5)

The upper connection portion 98 will now be described. The lower connection portion 97 has the same structure. As shown in FIG. 12 that is a sectional view taken along the line F—F of FIG. 10, the connection portion 98 is provided with a first bracket 115 mounted on the mounting portion P2 by bolts, a second bracket 116 mounted on the joint 99 by bolts, and a rotary shaft 117 for rotatably coupling the first bracket 115 and the second bracket 116 with each other.

The first bracket 115 has a bottom portion 118 fixed to the mounting portion P2 and a projection portion 119 projecting downwardly from the central portion thereof. A through hole 120 is formed in the projection portion 119.

Also, the second bracket 116 has a bottom portion 121 fixed to the joint 99 and a pair of clamping portion 122, 122 formed to project at a somewhat wider interval than a thickness of the projection portion 119 of the first bracket 115 on the upper side of the bottom portion 121. Through holes 123, 123 that are in alignment with each other are provided in the clamping portions 122, 122. The rotary shaft 117 is at its one end portion with a flange portion 124 and at the other end portion with a stop plate 125.

Then, the projection portion 119 of the first bracket 115 is clamped between the clamping portions 122, 122 of the second bracket 116. The rotary shaft 115 is inserted into the through hole 120 of the projection portion 119 and the through holes 123 and 123 of the clamping portions 122 and 122. Thus, the first bracket 115 and the second bracket 116, i.e., the mounting portion P2 and the damping device 91 are rotatable to each other.

Thus, the mounting portions P1 and P2 and the damping device 91 are connected to each other through the rotatable connection portions 97 and 98 whereby it is possible to prevent the application of the excessive force to the damping device 91 when the mounting portions P1 and P2 are relatively shifted to each other in the lateral direction.

Embodiment 6

Figure 13:
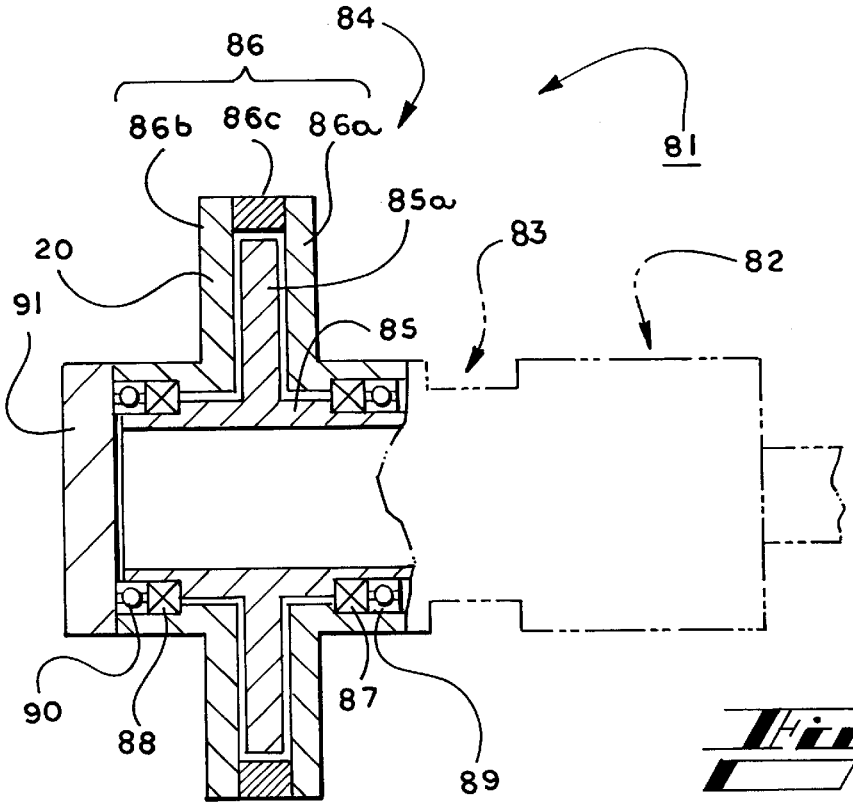
FIG. 13 is a cross-sectional view illustrating other structure of a damping device according to the embodiment (Embodiment 6).

FIG. 13 is a cross-sectional view illustrating a primary part of a structure of a damping device 81 to which the present invention is applied. Also, this damping device 81 is provided with a rotary mechanism 82, a joint portion 83 and a damping portion 84 which are substantially the same as that of the damping device 1.

The damping portion 84 is provided with a rotary member 85 provided with a disc portion 85*a* and a housing 86 for receiving the rotary member 85. A gap between the inside of the housing 86 and the outside of the rotary member 85 is formed into a sealed space by sealing units 87 and 88. The viscous fluid 20 is filled therein.

The housing 86 is divided in the axial direction at the border of the disc portion 85*a* and is provided with a first housing 86*a* on the side of the connection portion 83, a second housing 86*b* on the side of a sealing cover 91 and a joint ring 86*c*.

The rotary member 85 is rotatably supported to the housing 86 by the bearings 89 and 90.

The moving mechanism of the sealing unit shown in FIG. 2, the structure of the fluid retainer chamber shown in FIG. 5, the bellows shown in FIG. 8 or the elastic member shown in FIGS. 9 and 11 may be provided for such damping device 81. In the same manner as in the first to fifth embodiments described above, it is possible to suppress the adverse affect concomitant with the pressure increase of the viscous fluid 20 to the sealing units 87 and 88 provided in the damping device 81 to thereby make it possible to enhance the durability and reliability of the damping device 81.

Incidentally, the moving member is not the rotary member but may be a member that moves in a linear fashion to the housing. In this case, a piston is provided as the moving member, the inner space within the housing is divided into two chambers by this piston. The passage or the gap between the piston and the housing is provided for communicating these chambers and the two chambers are filled with viscous fluid.

In such a damping device, in the process in which the piston is linearly moved to the housing, the fluid is moved from one chamber to the other chamber through the above-described passage or gap. The heat is generated due to the fluidization resistance when the fluid passes through the passage or gap whereby the dynamic energy is damped in accordance with the relative shift between the objects.

Then, according to the features of the present invention, it is possible to apply the structure to the sealing unit or the like for sealing the above-described two chambers or the gap for retaining the viscous fluid.

What is claimed is:

1. A damping device comprising:

a container connected to one of two points that move relatively to each other;

a moving member coupled to the other of the two points and received relatively movably within the container;

a sealing unit retained movably in a gap between said container and said moving member to form a sealed space within said container;

fluid received within said sealed space, to be heated by a frictional resistance or the like from said container and said moving body in correspondence with the relative shift between said moving member and said container, so as to convert into thermal energy the dynamic energy in correspondence with the relative shift between said two points; and a biasing means for biasing toward said sealed space said sealing unit for moving in response to the pressure of the fluid received in said sealed space, thereby changing the volume of said sealed space.

2. A damping device comprising:

a container connected to one of two points that move relatively to each other;

a moving member coupled to the other of said two points and received relatively movably within said container;

a sealing unit retained in a gap between said container and said moving member to form a sealed space within said container;

fluid received within said sealed space, to be heated by a frictional resistance or the like from said container and said moving body in correspondence with the relative shift between said moving member and said container, as a result to convert into a thermal energy a dynamic energy in correspondence with the relative shift between said two points; and a fluid retainer chamber connected to said sealed space for making it possible to pass said fluid between said fluid retainer chamber and said sealed space.

3. The damping device according to claim 2, wherein said fluid retainer chamber comprises a pressure responsive means for moving within said fluid retainer chamber in response to the pressure and for changing the volume of a fluid receiving portion in said fluid retainer chamber.

4. A damping device comprising;

a container connected to one of two points that move relatively to each other;

a moving member coupled to the other of said two points and received relatively movably within said container;

a sealing unit retained in a gap between said container and said moving member to form a sealed space within said container;

fluid received within said sealed space, to be heated by a frictional resistance or the like from said container and said moving body in correspondence with the relative shift between said moving member and said container, as a result to convert into a thermal energy a dynamic energy in correspondence with the relative shift between said two points;

a fluid retainer chamber connected to said sealed space for making it possible to pass said fluid between said fluid retainer chamber and said sealed space;

said fluid retainer chamber comprising a pressure responsive means for moving within said fluid retainer chamber in response to the pressure and for changing the volume of a fluid receiving portion in said fluid retainer chamber; and said fluid retainer chamber comprising a bellows for expanding and shrinking in response to the pressure of the fluid introduced therein and for changing the volume of said fluid receiving portion.

5. A damping device comprising:

a container connected to one of two points that move relatively to each other;

a moving member coupled to the other of said two points and received relatively movably within said container;

a sealing unit retained in a gap between said container and said moving member to form a sealed space within said container;

fluid received within said sealed space, to be heated by a frictional resistance or the like from said container and said moving body in correspondence with the relative shift between said moving member and said container, as a result to convert into a thermal energy a dynamic energy in correspondence with the relative shift between said two points; and an elastic member exposed in a part of a wall surface defining said sealed space and changing a volume in response to a pressure applied from said fluid.

6. The damping device according to claim 5, wherein said elastic member is a hollow form.

7. The damping device according to any one of claims 1 to 6, wherein said fluid comprises viscous fluid; said moving member comprises a rotary member received rotatably within said container; and further comprising a rotary mechanism which connects a relative shift between said two points into a rotary motion of the rotary member.

8. The damping device according to claim 7, wherein said rotary mechanism comprises a screw shaft coupled with the other of said two points and a nut threadedly engaged with said screw shaft.

* * * * *